United States Patent [19]

Hara

[11] Patent Number: 4,480,409

[45] Date of Patent: Nov. 6, 1984

[54] WIRE-TYPE DOOR OR OTHER WINDOW REGULATOR FOR AN AUTOMOTIVE VEHICLE

[75] Inventor: Yoshiji Hara, Yokohama, Japan

[73] Assignee: Kabushiki Kaisha Johnan Seisakusho, Ueda, Japan

[21] Appl. No.: 414,611

[22] Filed: Sep. 3, 1982

[30] Foreign Application Priority Data

Apr. 30, 1982 [JP] Japan ..... 57-72828

[51] Int. Cl.[3] ..... E05F 11/48

[52] U.S. Cl. ..... 49/352; 74/89.2

[58] Field of Search ..... 49/352; 74/89.2

[56] References Cited

U.S. PATENT DOCUMENTS 4,235,046 11/1980 Hess et al. ..... 49/352

FOREIGN PATENT DOCUMENTS 39259 11/1981 European Pat. Off. .
1782896 5/1976 Fed. Rep. of Germany .
2616331 11/1977 Fed. Rep. of Germany .
2750904 5/1979 Fed. Rep. of Germany .
573125 11/1945 United Kingdom .
1448795 9/1976 United Kingdom .
2022683 12/1979 United Kingdom ..... 49/352
2029895 3/1980 United Kingdom .
2083132 3/1982 United Kingdom .
2087973 6/1982 United Kingdom .

*Primary Examiner*—Kenneth Downey

[57] ABSTRACT

A wire-type door or window window regulator for an automotive vehicle comprises: (a) a bracket provided so as to support the door window pane; (b) a channel-shaped guide rail provided so as to move the bracket upward and downward therealong; (c) pulleys provided at both ends of the channel-shaped guide rail; (d) a wire extending between the two pulleys along the channel-shaped guide rail and attached to the bracket; (e) a wire moving or driving means having a drum and baseplate on which the drum stands, the wire being fixedly wrapped around the drum so as to turn the two pulleys according to the rotational direction of the drum; (f) two supporting elements, each being slightly compressed within the gap between the baseplate and the ends of the guide rail so as to maintain the tension of the wires; and (g) two wire guide members, each engaging the corresponding supporting element to the wire extended between the drum and corresponding pulley, whereby a predetermined tension can always be applied to the wire and the configuration of the wire-type door window regulator can be maintained during shipping and thereafter.

13 Claims, 5 Drawing Figures

WIRE-TYPE DOOR OR OTHER WINDOW REGULATOR FOR AN AUTOMOTIVE VEHICLE

BACKGROUND OF THE INVENTION

1. Field of the Invention

The present invention relates to a wire-type door or other, window regulator for an automotive vehicle.

2. Description of the Prior Art

A conventional wire-type door or other window regulator comprises: (a) a window pane guide section having a channel-shaped rail which guides a window pane and a bracket to which the lower edge of the window glass pane is attached such that the bracket can slidably move up and down along the guide rail and accordingly the window glass pane can move up and down; (b) a window pane driving section having a drum and mechanism for rotating the drum; and (c) a wire extending between the window glass guide and driving sections so as to transmit the driving force of the drum to the bracket.

In the conventional wire-type door or other window regulator described above, the wire extends along the guide rail and both ends thereof are wrapped around and fixed to the drum so that when one end of the wire is wound up and accordingly the other end thereof is unwound, the window pane connected to the bracket of the window pane guide section is moved upward or downward.

However, it is difficult to maintain the wire of the conventional door or other window regulator extending from the drum to the window pane guide section completely tense during its shipment i.e. before the wire type door or other regulator is mounted on a vehicle door inner panel or vehicle body panel. This can apply equally well to a case in which the wire is loosened due to repetitive operations of the drum through the drum rotating mechanism, e.g. operating handle, i.e. either before or after mounting of the regulator on such vehicle panel.

Therefore, some means have been developed to cope with such a problem. For example, a Bowden wire-type door or other window regulator has been developed, wherein a relatively rigid tube extends between the drum and each guide rail with a slight curve and a spring is provided within each tube so as to stretch the wire through the tube in a tense state.

Such a system, however, is complex in structure, heavy, and expensive, and furthermore requires many parts and greater assembly time.

SUMMARY OF THE INVENTION

With the above-described problems in mind, it is an object of the present invention to provide a new wire-type door or other window regulator for an automotive vehicle, wherein means is provided for continuously applying tension to the wire described above during the assembly operation and for reliably correcting any loosening of the wire during manual assembly, shipment and repetitive operations of the wire type regulator, as well as any elongation of the wire itself due to the repetitive use thereof over a long period of time.

This can be achieved by providing two flexible cables, one extending along the wire running from the drum to an upper pulley attached to the upper end of the guide rail, the other extending along the wire running from the drum to a lower pulley attached to the lower end of the guide rail, each curved slightly or suitably and having a wire guide member at intermediate positions therealong which slidably grasp the corresponding wire.

BRIEF DESCRIPTION OF THE DRAWINGS

The features and advantages of the present invention will be better appreciated from the following description and attached drawings in which like reference numerals designate corresponding elements and in which.

DETAILED DESCRIPTION OF THE PREFERRED EMBODIMENT

Reference will be made hereinafter to the attached drawings in order to facilitate understanding of the present invention.

Figure 1:
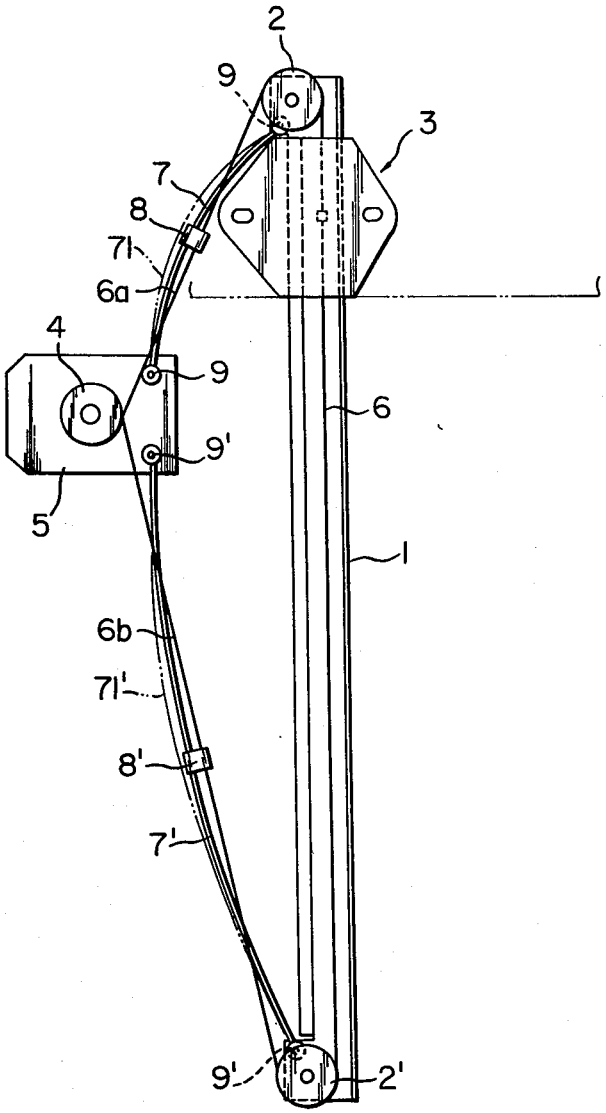
FIG. 1 is a front view of a preferred embodiment according to the present invention.

First, in FIG. 1, which shows a preferred embodiment according to the present invention, numeral 1 denotes a fixed channel-shaped guide rail, at both upper and lower ends of which pulleys 2 and 2' respectively are provided. A bracket 3 attached to the lower edge of a window pane as shown in phantom lines fits into the guide rail 1 so that the window pane can be moved upward or downward between the pulleys via the bracket 3.

Numeral 4 denotes a drum rotatably attached to a baseplate 5 so as to rotate in accordance with the rotation of an operating handle (not shown in FIG. 1) or in accordance with the rotation (Normal or reverse direction) of an electric motor. These parts conveniently constitute an appropriate wire moving means or wire driving means.

Numeral 6 denotes a wire, one end of which is preferably fixed to a hole (not shown) provided in the drum 4 and several turns of which are wrapped around the drum 4. The wire 6 extends toward the lower pulley 2' and the upper pulley 2, and then back to the drum 4, where several turns of the other end are again wrapped around the drum 4 and preferably fixed into a hole (not shown) provided in the drum 4. It should be noted that an intermediate position of the wire 6 between both upper and lower pulleys 2 and 2' is fixed to the bracket 3.

When the drum 4 is rotated counterclockwise as seen in FIG. 1, the lower wire 6*b* is wound up in the drum 4 and simultaneously the upper wire 6*a* is unwound from the drum 4. Therefore, it can be seen that the bracket 3 moves downward along the guide rail 1 so that the window glass pane moves downward accordingly. On the other hand, when the drum 4 is rotated clockwise, the upper wire 6*a* is wound up in the drum 4 and simultaneously the lower wire 6*b* is unwound from the drum 4. Therefore, it can be seen that the bracket 3 moved upward along the guide rail 1 so that the window glass pane moves upward accordingly. Thus, the bracket 3 and, in turn, the window glass pane are supported and arranged for reciprocal movement longitudinally along the longitudinal guide rail 1 intermediate the correspondingly opposed longitudinally spaced apart points at which the pulleys 2, 2' are connected to the rail.

It should be noted that the usual wire type door or other window regulator, comprising guide rail 1, pulleys 2, 2', bracket 3, wire 6, drum 4, and baseplate 5, inherently forms a more or less self-contained unit upon being assembled, and that after shipment such regulator or unit is mounted by attaching both guide rail 1 and baseplate 5 securely to a door inner panel or body panel of the vehicle whereby the rail and base plate are arranged in fixed relation to each other, e.g. as schematically shown in FIG. 1.

Furthermore, numerals 7 and 7' denote upper and lower supporting cable elements, respectively, made of metal wire, synthetic resin, carbon graphite, glass fiber, or some other flexible material which is essentially rigid in compression. The upper supporting cable element 7 extends along the upper wire 6*a* with one end fixed to the upper end of the guide rail 1, preferably via an upper pin 9 provided near the upper pulley 2, and the other end fixed to the upper edge of the baseplate 5, preferably via another upper pin 9 provided near the drum 4. On the other hand, the lower supporting cable element 7' extends along the lower wire 6*b* with one end fixed to the lower end of the guide rail 1, preferably via a lower pin 9' provided near the lower pulley 2', and the other end fixed to the lower edge of the baseplate 5, preferably via another lower pin 9' provided near the drum 4.

Figure 3A:
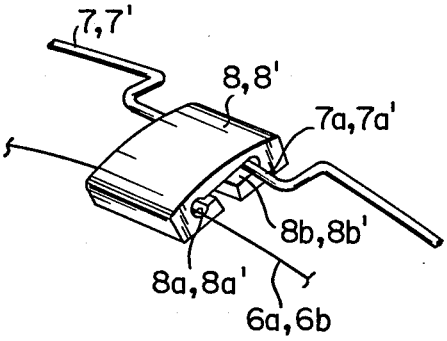
FIGS. 3(*a*) and 3(*b*) are, respectively, a perspective view and a top plan view of a wire guide member provided at an intermediate position along the supporting cable shown in FIG. 1.
Figure 3B:
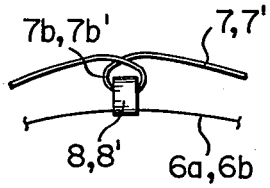

It should be noted that the upper and lower supporting cable elements 7, 7' are designed to be suitably curved. An upper wire guide member 8 made of synthetic resin, etc., is attached to the upper supporting cable element 7 near the center thereof (i.e., the position at which the deflection of the upper supporting cable element 7 from the upper wire 6*a* is maximized). On the other hand, a lower wire guide member 8' made of the same material is similarly attached to the lower supporting cable element 7' near the center thereof. These wire guide members 8 and 8' have wire guide passages 8*a*, 8*a*', respectively, which are in slidable engagement with the respective wires 6*a*, 6*b* extending from the drum 4 to the upper and lower pulleys 2, 2'. The relationship of these wire guide members 8 and 8' with the upper or lower wire 6*a*, 6*b* can be appreciated from FIGS. 3(*a*) and 3(*b*).

Figure 2A:
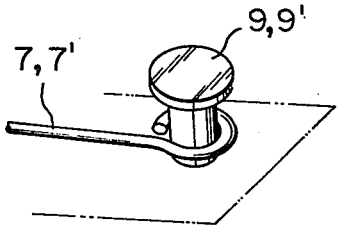
FIGS. 2(*a*) and 2(*b*) are, respectively, a perspective view and a top plan view of a pin at which a supporting wire shown in FIG. 1 is fixed.
Figure 2B:
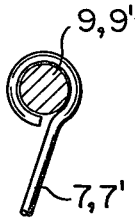

The supporting cable elements 7, 7' are attached to the upper or lower pins 9, 9' projecting from the baseplate 5 or guide rail 1, as the case may be, as seen in FIG. 1, with the ends thereof being wrapped around these pins 9, 9' as seen in FIGS. 2(*a*) and 2(*b*). The engagement portions 8*b*, 8*b*' of the upper and lower wire guide members 8 and 8' are fixed to the upper and lower supporting cable elements 7, 7' via steps or C-shaped bends 7*a*, 7*a*' formed by bending the center parts thereof as appreciated from FIG. 3(*a*), or alternatively via loops 7*b*, 7*b*' formed at the center parts thereof as appreciated from FIG. 3(*b*). Therefore, the wire guide members 8, 8' can be held near the centers of the upper and lower supporting cable elements 7, 7', respectively.

The upper and lower supporting cable elements 7, 7' are curved in the relaxed state as shown by the phantom lines 71 and 71' in FIG. 1 since no load is applied thereon when they are assembled. When the upper and lower wires 6*a*, 6*b* are inserted through the wire guide members 8, 8', the tension of the wires causes the upper and lower supporting cable elements 7, 7' to be distorted or slightly compressed into the shape shown by the solid lines in FIG. 1.

As the tension of the wires 6*a*, 6*b* decreases, the upper or lower supporting cable elements 7, 7' gradually pull the upper and lower wires 6*a*, 6*b*' toward the phantom lines 71, 71', respectively. Consequently, the wire 6 always is suitably tense i.e. under stretching tension continuously applied thereto via the guide members 8,8' attached to the curved or arcuately inherently precocked flexible linear cable elements 7, 7' which are essentially rigid in compression and thus which are resiliently displaceable crosswise of their longitudinal axis without being essentially displaceable in the compression direction along such axis, e.g. inherently in the manner of a leaf spring.

As described hereinbefore, an improved wire-type door window regulator may therefore be provided according to the present invention of the kind wherein only two supporting cables curvedly bridge the gap between the drum and upper and lower pulleys located at both ends of the guide rail, whereby the wire-type door window regulator can maintain the configuration of the wire in the drum and two pulleys during shipment in a tense state and accordingly the assembly into the panel of the vehicle is facilitated, and whereby a predetermined tension of the wire extending from the drum can be maintained by the deformation-restoring force (biasing force) of the supporting cables and accordingly the loosening of the wire during assembly of the wire into the drum and two pulleys and after the repetitive manipulations of the drum by means of, e.g., the operating handle as well as elongation of the wire itself due to the repetitive manipulation over a long period of time can be eliminated.

By reason of the arrangement of the two opposed supporting and biasing elements, such as the cables 7, 7', which correspondingly operatively interconnect the base plate 5 and a corresponding portion of the rail 1, adjacent a corresponding said pulley, a biasing force is correspondingly applied in the direction of separating the base plate and the corresponding portion of the rail, which advantageously maintains the wire circuit under biasing tension, e.g. before the rail and base plate are arranged in the vehicle panel in fixed relation to each other. On the other hand, when the rail and base plate are so arranged in fixed relation to each other, the contemplated wire slidably retainingly engaging means, such as the guide member 8 or 8', arranged on each of the supporting and biasing elements for operatively slidably retainingly engaging the wire at the correspondingly adjacent length thereof extending between the drum and the correspondingly adjacent pulley, serves for correspondingly maintaining the wire portion thereat and in turn the wire circuit under biasing tension corresponding to such biasing force.

It will be fully understood by those skilled in the art that midifications may be made in the preferred embodiment described hereinbefore without departing the spirit and scope of the present invention, which is to be defined by the appended claims.

What is claimed is:

1. Wire-type window regulator for a window which is useable for moving a window panel upward and downward which comprises:

a longitudinal guide rail having two opposed pulleys connected to the rail at correspondingly opposed longitudinally spaced apart points on the rail, and further having a bracket supported on the rail for reciprocal movement therealong intermediate said points, the bracket being adapted to support a window pane for corresponding movement relative to the rail;

a wire driving drum rotatably mounted on a baseplate, a wire mounted on the drum and on the two pulleys for guided movement by the pulleys upon rotation of the drum and forming a wire circuit operatively interconnecting the base plate and rail, including one wire circuit portion extending between the two pulleys and along the rail and attached to the bracket, and further including another wire circuit portion extending between the two pulleys and operatively wrapped around the drum, permitting movement of the wire in a direction toward one of the pulleys and away from the other pulley according to the direction of rotation of the drum and correspondingly permitting movement of the bracket along the rail, the rail and base plate being arranged in fixed relation to each other, two opposed supporting and biasing elements correspondingly operatively interconnecting the baseplate and a corresponding portion of the rail adjacent a corresponding said pulley and arranged for correspondingly applying a biasing force in the direction of separating the base plate and the corresponding portion of the rail, each of the supporting and biasing elements being provided with a wire slidably retainingly engaging means arranged thereon for operatively slidably retainingly engaging the wire at the correspondingly adjacent length thereof extending between the drum and the correspondingly adjacent pulley for correspondingly maintaining the wire portion thereat and, in turn, the wire circuit under biasing tension corresponding to said biasing force.

2. Regulator according to claim 1, wherein the supporting and biasing elements are in the form of linear flexible elements which are essentially rigid in compression and resiliently displaceable crosswise of their longitudinal axis without being essentially displaceable in the compression direction along said axis.

3. A wire-type door or other window regulator for an automotive vehicle which operatively moves a window pane of a vehicle upward and downward, comprising:

(a) a bracket provided so as to support the window pane, (b) a channel-shaped guide rail for supporting said bracket while allowing it to move upward and downward therealong, (c) two pulleys, one provided at each end of said channel-shaped guide rail, (d) a wire extending between the two pulleys along the channel-shaped guide rail and attached to said bracket, (e) wire driving means having a rotatable drum and a baseplate on which said drum stands, said wire being fixedly wrapped around said drum so as to move toward one of said two pulleys according to the rotational direction of said drum, (f) at least one supporting element connected between said base plate of said wire driving means and one end of said guide rail and applying a biasing force in the direction of separating said base plate and the corresponding end of said guide rail, and (g) at least one wire guide member having a first engaging portion for connecting said wire guide member to said supporting element and a second engaging portion for connecting said wire guide member to the corresponding portion of said wire extending between the drum of said wire driving means and the corresponding pulley.

4. The wire-type window regulator as set forth in claim 3, wherein the first engaging portion of said wire guide member is constructed in a C-shaped cross section through which a substantially central part of said supporting element extends and is engaged thereat with said wire guide member such that said supporting element runs through said C-shaped cross section.

5. The wire-type window regulator as set forth in claim 3, wherein the first engaging portion of said wire guide member is constructed in a C-shaped cross section through which a substantially central part of said supporting element extends and is engaged thereat with said wire guide member such that said supporting element is wrapped around said C-shaped cross section.

6. The wire-type window regulator as set forth in claim 3 which further comprises at least two pins, one of said pins projecting from said base plate and having one end of said supporting element firmly wrapped therearound and the other of said pins projecting from one end of said channel-shaped guide rail opposing said base plate and having the other end of said supporting element firmly wrapped therearound.

7. The wire-type window regulator for an automotive vehicle as set forth in claim 3, wherein said supporting element is made of a linear flexible material which is essentially more rigid in compression than said wire and resiliently displaceable crosswise of a longitudinal axis thereof without being essentially displaceable in the compression direction along said axis.

8. The wire-type window regulator as set forth in claim 7, wherein said supporting element is made of a metallic wire cable.

9. The wire-type window regulator as set forth in claim 7, wherein said supporting element is made of a synthetic resin.

10. The wire-type window regulator as set forth in claim 7, wherein said supporting element is made of fiber glass.

11. The wire-type window regulator as set forth in claim 7, wherein said supporting element is made of graphite.

12. Wire-type window regulator for a window which is usable for moving a window pane upward and downward, which comprises:

a longitudinal guide rail having two opposed pulleys connected to the rail at correspondingly opposed longitudinally spaced apart points on the rail, and further having a bracket supported on the rail for reciprocal movement therealong intermediate said points, the bracket being adapted to support a window pane for corresponding movement relative to the rail, a wire driving drum rotatably mounted on a base plate, a wire mounted on the drum and on the two pulleys for guided movement by the pulleys upon rotation of the drum and forming a wire circuit operatively interconnecting the base plate and rail, including one wire circuit portion extending between the two pulleys and along the rail and attached to the bracket, and further including another wire circuit portion extending between the two pulleys and operatively wrapped around the drum, permitting movement of the wire in a direction toward one of the pulleys and away from the other pulley according to the direction of rotation of the drum and correspondingly permitting movement of the bracket along the rail, and two opposed supporting and biasing elements correspondingly operatively interconnecting the base plate and a corresponding portion of the rail adjacent a corresponding said pulley and arranged for correspondingly applying a biasing force in the direction of separating the base plate and the corresponding portion of the rail for maintaining the wire circuit under biasing tension, each of said supporting and biasing elements being provided with a wire slidably retainingly engaging means arranged thereon for operatively slidably retainingly engaging the wire at the correspondingly adjacent length thereof extending between the drum and the correspondingly adjacent pulley for correspondingly maintaining the wire portion thereat under biasing tension.

13. Regulator according to claim 12, wherein the supporting and biasing elements are in the form of linear flexible elements which are essentially rigid in compression and resiliently displaceable crosswise of their longitudinal axis without being essentially displaceable in the compression direction along said axis.

* * * * *